United States Patent [19]

Palmer et al.

[11] 4,098,431

[45] Jul. 4, 1978

[54] CHEMICAL REPLENISHING SYSTEM

[75] Inventors: Jack Palmer; Sidney Weisser, both of Mamaroneck, N.Y.

[73] Assignee: Cine Magnetics Inc., Mamaroneck, N.Y.

[21] Appl. No.: 759,062

[22] Filed: Jan. 13, 1977

[51] Int. Cl.[2] ..... B67D 5/32

[52] U.S. Cl. ..... 222/39; 222/64; 222/88; 222/143

[58] Field of Search ..... 222/39, 64, 65, 68, 222/69, 81, 82, 83.5, 85, 86, 88, 143, 183; 312/284; 220/23.2, 23.4, 23.8; 340/244 C

[56] References Cited

U.S. PATENT DOCUMENTS

| | | | |
|---|---|---|---|
| 406,527 | 7/1889 | Meriam | 222/83.5 |
| 2,029,334 | 2/1936 | Nall | 222/86 |
| 2,258,636 | 10/1941 | Young et al. | 222/83.5 X |
| 2,806,635 | 9/1957 | Kader et al. | 222/88 |
| 3,092,106 | 6/1963 | Butler | 222/88 X |
| 3,187,757 | 6/1965 | Jones et al. | 222/143 X |
| 3,392,581 | 7/1968 | Miller | 340/244 C X |
| 3,538,866 | 11/1970 | Gaines | 222/83.5 X |
| 3,695,485 | 10/1972 | Littlejohn | 222/68 |
| 3,831,813 | 8/1974 | Latham | 222/81 |

*Primary Examiner*—Robert B. Reeves
*Assistant Examiner*—Fred A. Silverberg
*Attorney, Agent, or Firm*—Toren, McGeady and Stanger

[57] ABSTRACT

A chemical replenisher system for supplying developer and fixer chemicals to a processor is disclosed. A developer and fixer tank are disposed side-by-side and coupled to the processor by way of hoses. A container-coded dispenser atop the tanks provides a substantially error-free arrangement for introducing the component chemicals into the tanks. A unique outline geometry is associated with each component container. By relating this geometry to a corresponding opening in a template of the dispenser, the introduction of the component chemicals is made error-free. The template openings also serve as guides for the containers. Uniquely designed knife assemblies are disposed below the template openings for piercing the tops of the sealed, chemical-filled containers upon inserting the containers into the template openings. Water is supplied under increased pressure as a mixing source is provided to each tank. A system of sensors provides low level alarm activation and automatic water shut-off.

8 Claims, 10 Drawing Figures

CHEMICAL REPLENISHING SYSTEM

FIELD OF THE INVENTION

The invention is an improvement in the dispensing of developer and fixer chemicals to a developer and fixer replenishing system for use with a film processing system, such as for X-ray film.

BACKGROUND OF THE INVENTION

In prior replenishing systems, large tanks of developer and fixer were mixed, usually by hand, to provide the necessary replenishing solution or were filled with ready-to-use solutions from large containers. The use of large storage tanks of developer and fixer insured that there would be no shortage of solution when required. The mixing was both messy and subject to human error. Further, the storage space required by the large replenisher tanks was clearly objectionable. The odors generated by such large-volume stored solutions were also found to be annoying. Finally, this prior system required storage of ready-to-use solutions which lost their effectiveness with time.

One approach for eliminating the use of large replenisher tanks was the provision of smaller tanks to which component concentrate solutions of developer and fixer could be supplied when needed, together with the necessary water. Such a system, while an improvement over the use of pre-mixed, ready-to-use solutions nevertheless required hand addition of the component solutions into single entry openings. Thus, some degree of mess and odor still resulted and the erroneous introduction of the developer solution into the fixer portion and vice versa was stil quite possible.

Various systems of loading and introducing chemicals into tanks in an automatic or semi-automatic fashion are known. One such known system employs the automatic movement of knives to penetrate fixed containers in order to release the solution on demand. In this known arrangement, the movable knives are actuated by water pressure. Accordingly, when the water pressure is low, such system will fail to operate or, even worse, would not puncture all of the containers, resulting in a contaminated mixture.

SUMMARY OF THE INVENTION

The present invention is designed to overcome many of the various drawbacks of the known prior art.

It is an object of this invention, therefore, to provide a positive method and arrangement for loading developer and fixer chemicals into a replenishing system so that the developer and fixer chemicals can not easily be accidentally interchanged.

It is also an object of the present invention to provide a dispenser system and device for loading chemicals into the developer and fixer portions of the replenishing system wherein the loading of the chemicals is done in a relatively automatic and substantially error-free fashion.

It is a further object of the present invention to provide a system and device for introducing chemicals into the developer and fixer portions of a replenishing system which minimizes the mess of such introduction and also reduces odors to a minimum.

It is an additional object of the present invention to provide a replenishing system for developer and fixer solutions where water is added to concentrated chemical components and wherein the system automatically shuts off the water supply when a predetermined amount has been added.

It is a still further object of the present invention to provide a relatively automatic system for introducing component developer and fixer solutions into a replenishing system which calls for additional chemicals when the system reaches a certain level, by the use of audio and visual alarm systems.

It is yet another object of the present invention to eliminate the need for having large pre-mixed or ready-to-use containers of developer and fixer on hand for use in a replenishing system.

It is still another object of the present invention to provide a system and device wherein the chemicals are released from the component chemical containers upon loading, without the possibility of failure, by the use of stationary piercing elements.

It is still a further object of the present invention to provide a system and device for supplying developer and fixer component chemicals to a replenisher system in a consistent manner so that the repeatability of the developed images is maintained.

In accordance with the present invention, a liquid dispenser unit adapted for use with a chemical replenisher system comprises a container-coded template having openings of predetermined geometric configuration, the openings corresponding to respective geometric outlines of chemical containers adapted for use with the template. Also included is a plurality of stationary knives, each knife disposed below a corresponding opening, each knife adapted to pierce a fluid-filled container to release its contents.

Also in accordance with the present invention, a chemical replenishing system for supplying developer and fixer chemicals to a processor, comprises (A) a developer portion including a plurality of developer containers, each containing chemical fluids for providing photographic developing action, each container having a predetermined geometric outline, each container having a pierceable seal at one end thereof. Also included are a developer tank, a first support element bearing a plurality of stationary knives disposed above said developer tank, the support element having openings therein below the knives. A container-coded developer template is included having openings therein, each opening corresponding to a respective one of the developer containers. Each of the openings is arranged above a corresponding knife, wherein each opening provides loading identification of an associated container and also provides means to guide the container onto its respective knife.

Also included is a fixer portion (B) having a plurality of fixer containers, each containing chemical fluids for providing photographic fixing action, each container having a predetermined geometric outline, each container having a pierceable seal at one end thereof. A fixer tank and a second support element bearing a plurality of stationary knives disposed above said fixer tank are also included. The second support element has openings therein below the knives. Finally included is a container-coded fixer template having openings therein, each opening corresponding to one of the fixer containers, each of the openings being arranged above a corresponding knife wherein each opening provides loading identification for an associated container and provides means to guide the container onto its respective knife. In this manner, the loading of a container into a template opening and onto a knife will cause the knife to pierce the seal of the container and allow the fluid contained therein to pass through the corresponding support element opening into the corresponding tank.

For a better understanding of the present invention together with other and further objects thereof, reference is made to the following description and accompanying drawings while the scope of the invention is pointed out in the appended claims.

DESCRIPTION OF THE INVENTION

Figure 1:
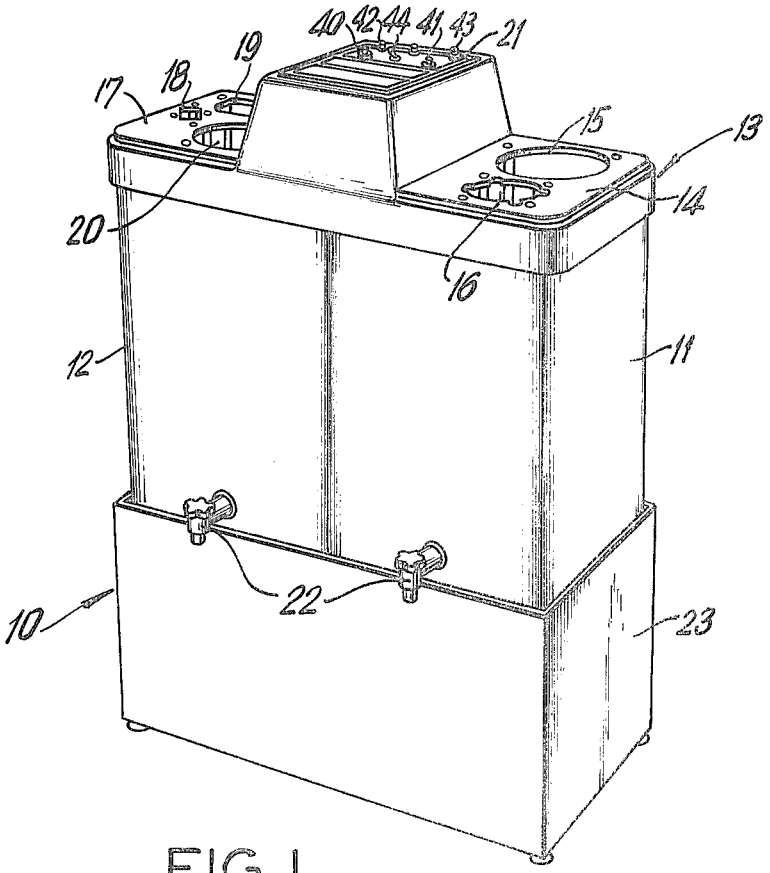
FIG. 1 represents a perspective view of the replenisher system of the present invention.
Figure 2:
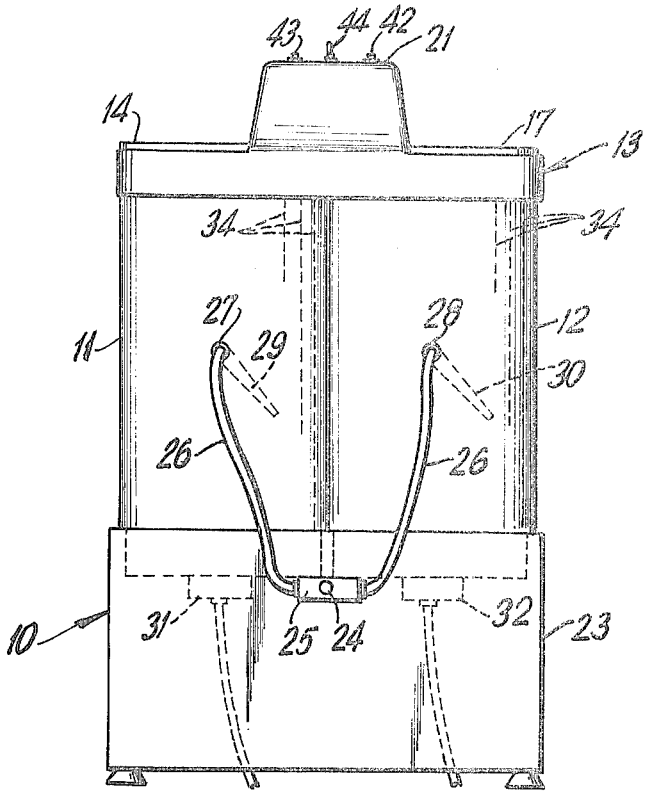
FIG. 2 is a rear view of the replenisher system of FIG. 1 showing certain additional features.

The replenishing system of the present invention is designed to operate with a processor, such as an X-ray processing system. Reference to FIG. 1 shows that the basic replenishing system 10 is comprised of two side-by-side tanks, 11 and 12. In one system in accordance with the present invention, the tanks may be, for example, 10 gallon tanks. In the description, tank 12 will be referred to as the developer tank and tank 11, the fixer tank. Each of the tanks is coupled by way of hoses 31 and 32 (see FIG. 2) from the bottom of the tanks of the replenisher system to the processor (which is not shown). The processor draws the fixer and developer solutions by pumping action, as required.

Means are provided to introduce water 24 (see FIG. 2) through electric solenoid control valves 25. The solenoid valves connect by way of hoses 26 to inlet nozzles 27 and 28 in FIG. 2. The inlet nozzles have portions 29 and 30 which are oriented at a downward angle to the horizontal, such as 45°. Each inlet nozzle is reduced to a small opening, internal to each of the tanks, such as an opening of 3/16 inch. The increased pressure developed at the 3/16 inch inlet point is used as a non-mechanical source of mixing for the developer and fixer solutions. The system is designed to be connected to a supply having ordinary water pressure from a commercial or home water tap. The water inlet arrangement is designed to introduce water at a low enough level to prevent splashing. Splashing might activate the water shut off high level sensor prematurely.

Again, referring to FIG. 1, the developer and fixer chemicals are introduced into the tanks by way of the dispenser system shown as 13. The dispenser system includes container-coded developer and fixer templates 17 and 14. Dispenser template 17 typically includes openings 18, 19 and 20 and fixer template 14 typically includes openings 15 and 16. The template openings are intended for introducing the chemicals to the developer and fixer tanks. This will be discussed in more detail below.

Figure 3:
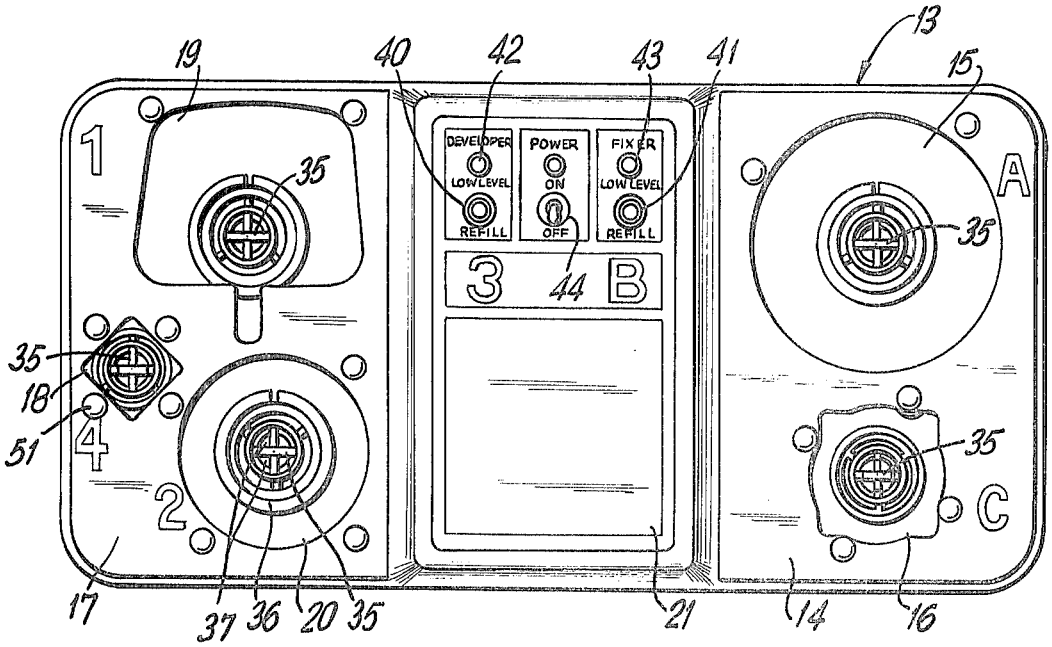
FIG. 3 is a plan view of the dispenser portion including the container-identifying template and the control panel of the present invention.

Also shown in FIG. 1 is the control panel 21 which is illustrated in more detail in FIG. 3. Drain spigots 22 are also provided at the bottom of each tank. A base support for the tanks is indicated as 23.

The dispenser system 13 can be more readily described by reference to FIGS. 3 and 4. FIG. 3 illustrates that the template openings of the developer portion and fixer portions have unique geometric outlines. These outlines correspond to the geometric outlines of containers having certain chemical solutions for introduction into each of the openings. Accordingly, the template openings represent container-coded information by which the loading of the individual containers can be effected. In this manner, the shape of the openings of the templates provides a primarily error-free arrangement for the introduction of the chemicals.

Figure 4:
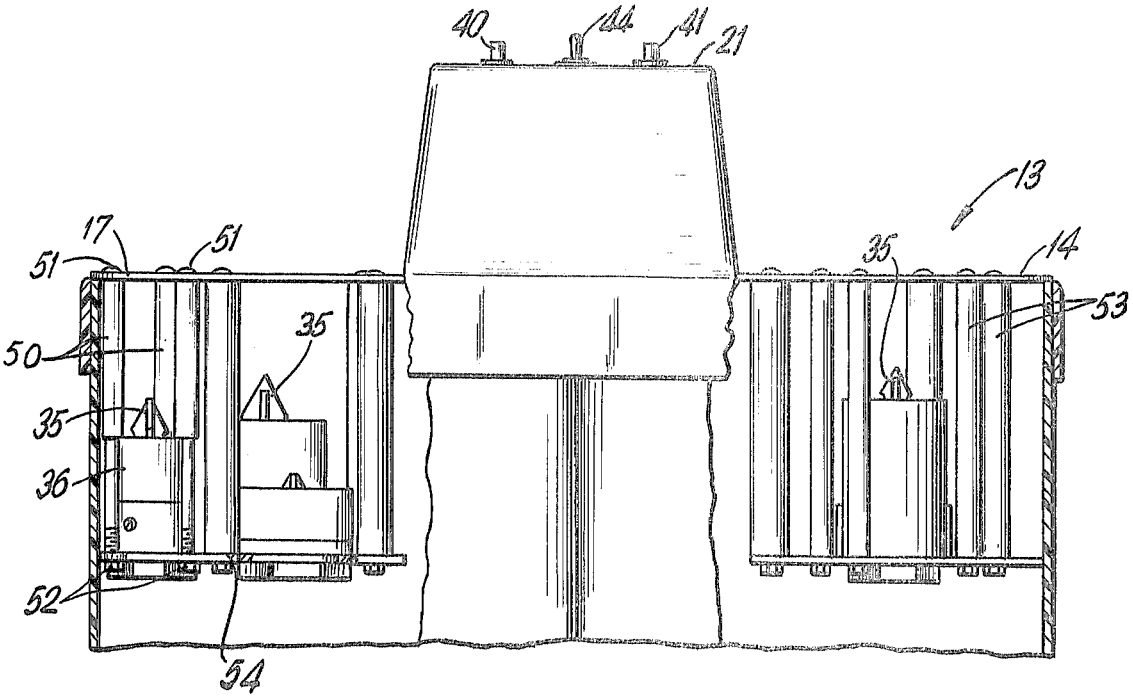
FIG. 4 is a side view in partial section of the dispenser portion of the replenisher.

As seen in FIGS. 3 and 4, below each of the template openings is a corresponding piercing knife, preferably a plastic knife of crossed design. Each of the knives 35 is disposed in a funnel-like element such as an annular collar 36. The funnel-like element directs the flow of fluids toward the tank. As seen in FIG. 4, the knives 35 extend a small predetermined distance above their respective collar 36 so that no fluid can escape and the fluid will all be directed into the tank. The knives are disposed on a support element 54, as shown in FIG. 4.

Figure 5:
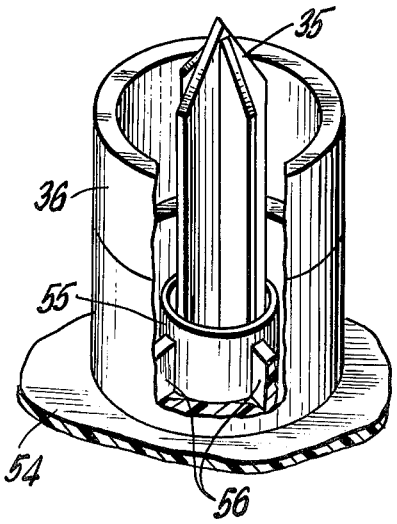
FIG. 5 illustrates a detail partial sectional view showing one embodiment of the knife assembly of the present invention.
Figure 6:
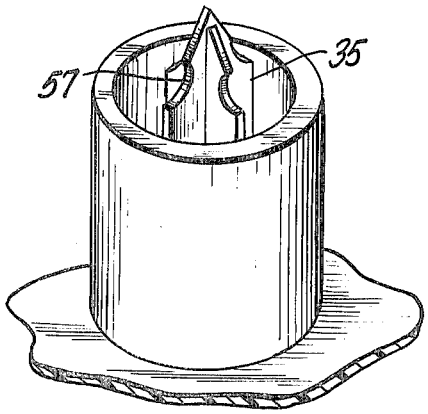
FIG. 6 shows in perspective view another embodiment of the knife assembly of the present invention.

It will be seen in FIG. 3 that the knives have openings between the blades and the support element 54 also has openings surrounding and below the knife assemblies so that the fluid can enter the tank appropriately. These openings are shown as 37 in FIG. 3. Reference to FIGS. 5 and 6 indicate two embodiments of the knife assemblies of the present invention. The knife 35 in FIG. 5 has linearly sloping edges. As shown in FIG. 6, the knife 35 also includes notches 57 for the lip of the container to rest upon. FIG. 5 also shows the support structure 56 for the knife. The knife assembly includes a small annular collar 55 which is fastened to the larger funnel-like element or collar 36 by way of the support structure 56.

Figure 8:
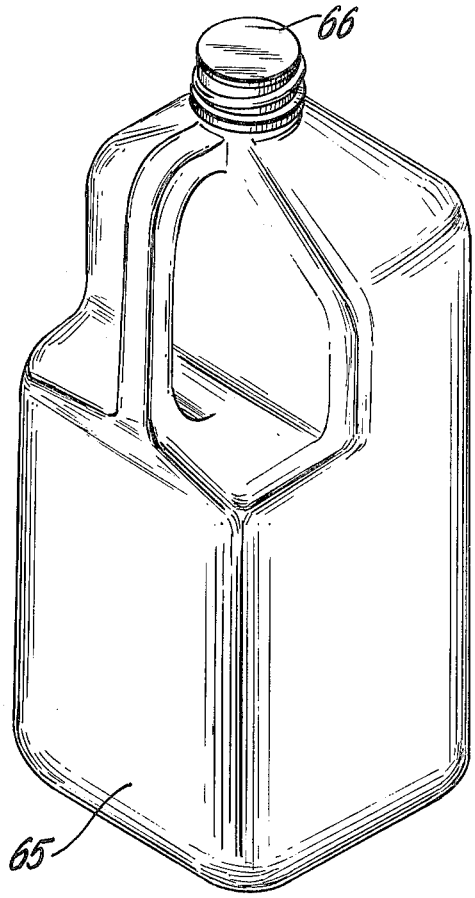
FIG. 8 is a perspective view of a container for use with the replenisher system of the present invention.

A typical container for use with the dispenser system is shown in FIG. 8 and includes a metallic seal 66. It is important that the sealed container 65 be constructed so that no leakage occurs upon inversion of the container prior to puncture by the knives. A hermetic seal of foil laminate is described in U.S. Pat. No. 2,937,480 and would be appropriate for this use.

Referring again to FIG. 3, the procedure for supplying the developer and fixer solution to the tanks will now be described. It should be noted that the control panel and template system has associated therewith a simplified step system using numbers in sequence and letters in sequence for the appropriate method steps of loading the chemicals and water. In the system hereafter described, the numbered steps refer to the developer and the lettered steps refer to the fixer.

In order to mix a five-gallon solution in the developer tank, it is necessary to provide what is known in the trade as Part 1 (which may be, for example, a concentrated solution including one or more developing agents i.e. Phenidone, Hydroquinone, Metol, activators such as alkali Salts of Carbonates, Borates, Phosphates, etc.

and/or Caustic Soda or Potash; Preservative such as Sodium or Potassium Sulfite, restrainers such as organic compounds known to the art, Potassium or Sodium Bromide, etc.; Solubilizers such as Glycols or Cellosolves; and other ingredients such as Anti Sludging agents) into the template opening labelled as 1. As explained above, it is necessary that the Part 1 container have a physical outline corresponding to the template opening. Beneath the template opening, as seen in FIG. 3, is the plastic piercing knife 35. The container, as also mentioned above, is provided with a metallic seal which is penetrable. Accordingly, when the Part 1 container is introduced and pressed down onto the knife, the knife will penetrate the seal, thus releasing the contents of the Part 1 container into the tank. This is done by way of the openings associated with the knife.

The knife construction itself is rather critical since it has been designed to open the foil or metallic seal as wide as possible without creating the possibility of metallic shards or pieces which may fall into the solution.

Another important feature and aspect of the present invention is that the template openings also serve as a guide for the containers as they slide downward toward the knife. Additional guidance for the containers upon loading may be provided by the posts 50 or 53 (see FIG. 4) which extend between the template and supporting member 54 for the support of member 54. Posts 50 or 53 are held in place by bolt element 51 and nut element 52.

In a fashion similar to the loading of the Part 1 container, the number 2 container (which may, for example, be additional buffers, preservatives, Anti-Sludging agents, organic gelatin hardeners such as Glutaraldehyde or Bisulfite salts of Glutaraldehyde) is then introduced so that its metal foil will be punctured by the knife disposed below the opening labelled 2 in the developer templates. Again, the contents of this container are emptied into the developer tank.

Step 3 in the supply of the developer solution is indicated on the control panel and is associated with the introduction of water under increased pressure to the chemical solutions previously added in steps 1 and 2. This is done by pressing the refill button 40 above the numeric 3 on the control panel 21. This action sends an electrical signal to the solenoid valve 24 which opens the water line 26 through the nozzle 27 described above.

Figure 7:
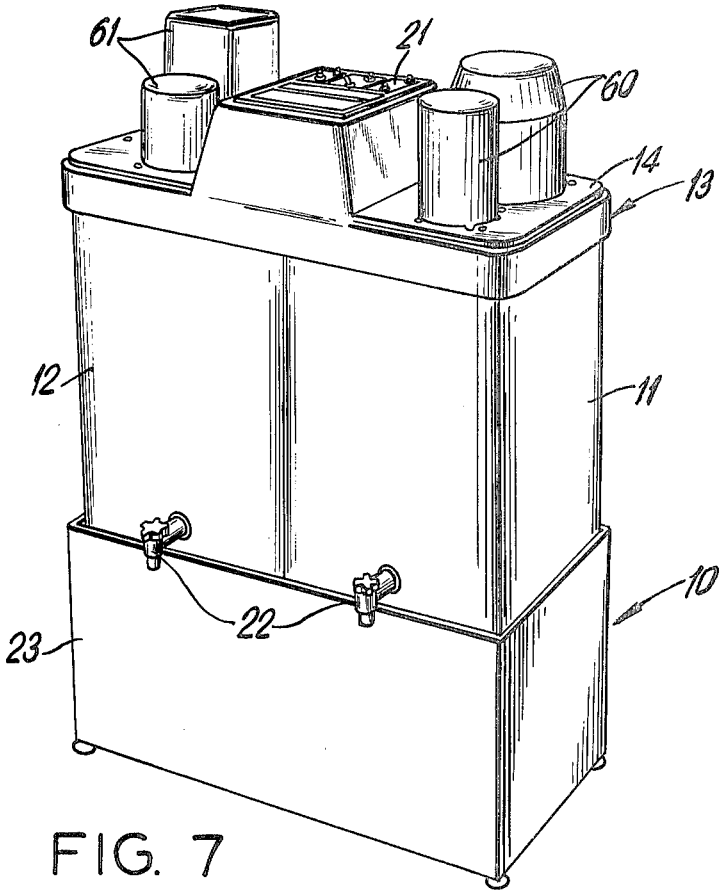
FIG. 7 is a perspective view of the replenisher system of the present invention also showing the inserted containers.

During the time the water is being introduced into the tank, it is necessary to load the final chemical solution, Part 4, in its appropriate template opening. The container, Part 4 (for example, a second or third developing agent such as Phenidone or Metol and carriers or solubilizers for the developing agent(s) such as Acetic Acid or solvents such as Glycols) will have its metal seal pierced by the knife disposed beneath its opening and the contents of container Part 4 added to the tank while the water is mixing the contents of the developer tank. FIG. 7 illustrates the developer containers 61 and the fixer container after insertion in the dispenser 13.

An electronic sensor system is provided to determine when the appropriate level in the tank is reached. In a preferred embodiment, sensing rods 34 are disposed so as to hang down from the dispenser portion. A longer sensing rod provides the electrical common. The high electrode of the sensing rods determines when the appropriate conductivity of the solution is reached (which represents the desired level of the solution). In a preferred arrangement, an additional sensor is also employed to determine a low level condition (for example, a one-gallon level) which determination is employed to operate a dual alarm system. The alarm system preferably includes a visual indication shown as 42 (or 43 for the fixer) and also preferably includes an aural alarm to warn the individual monitoring the system.

In a similar fashion, fixer chemicals are supplied to the fixer tank. First, chemical container Part A (for example, Fixing agents such as Ammonium or Sodium Thiosulfate - preservatives such as Sodium or Ammonium Sulfite, buffering and Anti-Sludging agents, and pH adjusters such as Acetic Acid) which is inserted into a special opening in the template corresponding to the outline of this container and the metallic seal is pierced by the knife upon loading. The chemicals of container A are thus introduced into the fixer tank. At this point, the water refill button B is pressed corresponding to 41 in FIG. 3 which supplies water under increased pressure by way of a similar high pressure inlet opening 27.

While the water is being introduced into the fixer tank by way of refill button B, the Part C chemical (for example, Gelatin Hardening agents of the family of Aluminum Salts and additional pH adjusters if desired) is supplied by way of its special container and the knife 35 disposed below its corresponding opening in the template, so that its contents will be introduced into the fixing tank. Again, this must be done while the water is entering the fixer portion. In a manner similar to the developer tank, electronic sensors determine when the appropriate fill point has been reached.

Figure 9A:
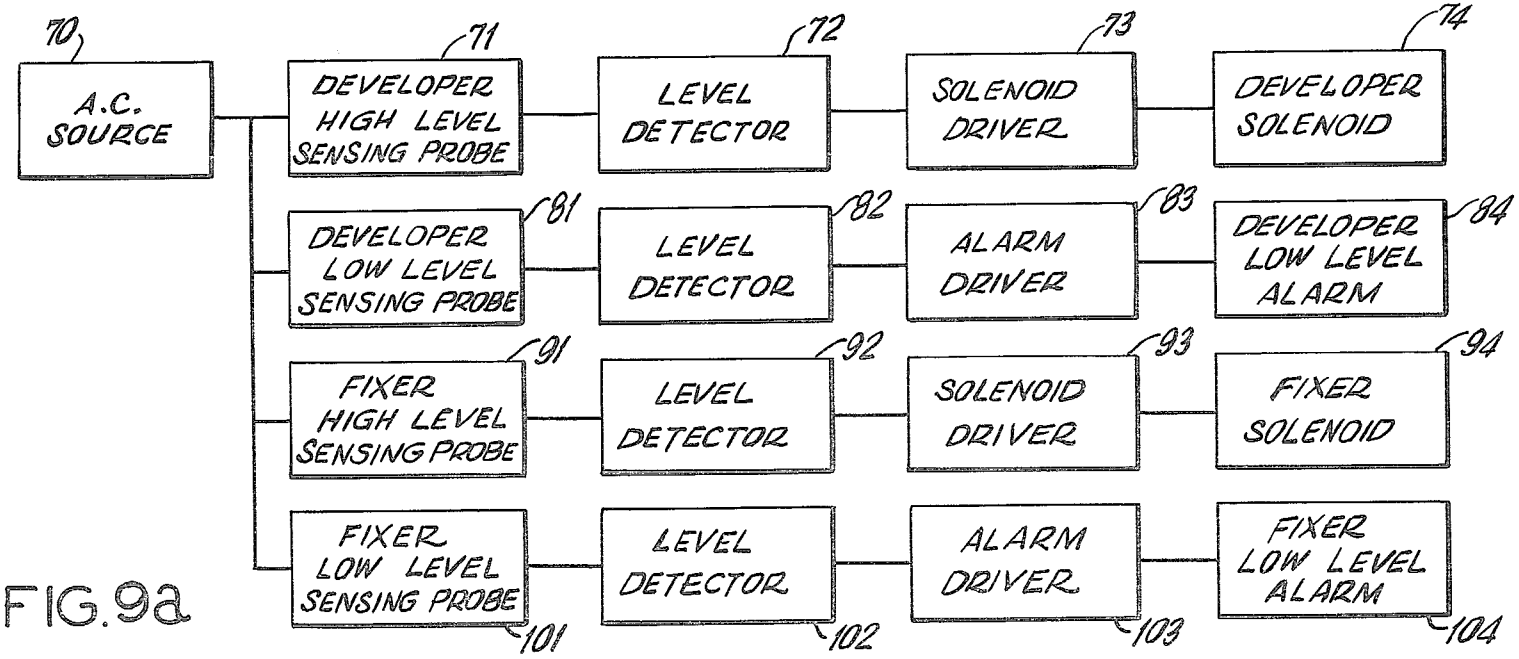
FIGS. 9*a* and 9*b* are block diagrams illustrating the level sensor circuitry and alarm arrangement of the present invention.

Referring to FIG. 9*a*, a block diagram arrangement is shown of the alarm and solenoid control arrangement for use with the present invention. In this arrangement, a low voltage a.c. source 70 is provided to the developer and fixer high level sensing probes 71 and 91 and the developer and fixer low level sensing probes 81 and 101. Alternating current is used to prevent electrolytic breakdown of the solution. The sensing probes provide an output which is a function of the conductivity of the solution. The liquid level is in turn a function of the conductivity.

Level detectors 72, 82, 92, 102, respectively respond to each of the probe outputs. The developer high level sensing probe 71 operates by way of level detector 72, solenoid driver 73 and developer solenoid 74 to cut off the supply of water when the appropriate predetermined developer level is reached. Similarly, fixer solenoid 94 cuts off the fixer water supply at the appropriate level by way of fixer high level sensing probe 91, level detector 92 and solenoid driver 93.

The developer low level alarm 84 is triggered (preferably aurally and visually) at the appropriate low level of the developer solution. Level detector 82 and alarm driver 83 respond to the developer low level sensing probe 81 to activate the alarm 84. The fixer low level alarm 104 operates in similar fashion from fixer low level sensing probe 101, level detector 102 and alarm driver 103.

Figure 9B:
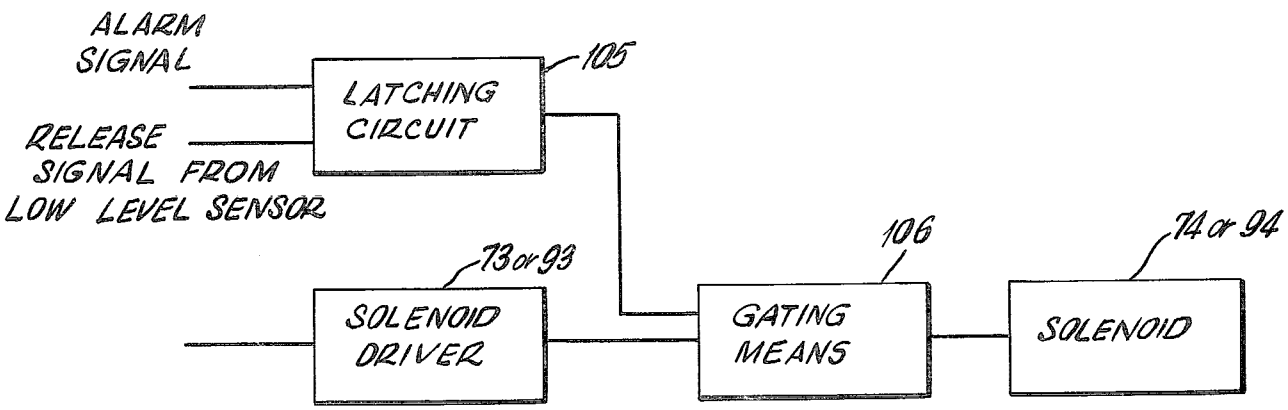

FIG. 9*b* illustrates a preferred arrangement for providing an additional safety feature for the system of the present invention. In this arrangement, the occurence of an alarm signal is employed to prevent the introduction of additional water. The alarm signal is supplied to latching circuit 105, which in turn supplies a blocking signal to gating means 106. Gating means 106 is an "AND" gate which will prevent the solenoid driver 73 or 93 from controlling the solenoid 74 or 94. Once the circuit is actuated by the alarm signal, pressing of the refill button will have no effect.

The circuit will remain in a "latched" condition until an appropriate release signal is applied from the low level sensor. This signal occurs upon the introduction of a predetermined quantity (for example, one gallon either Part 1 or Part A of the developer or fixer chemical solution.

In addition to the described construction of container-coded template openings and corresponding outlines of the chemical containers, it is also desired that the developer chemicals be color-coded differently from the fixer chemicals. Accordingly, all of the fixer containers may have, for example, red closures, while the developer containers may have black closures. The developer and fixer template portion 17 and 14 can have similar color codings.

There has been described a system which includes developer and fixer solutions. Other concentrate solutions which may be similarly loaded and used as a source of supply include bleach, cleaning bath, hypo neutralizers and similar solutions.

While the foregoing description and drawings represent the preferred embodiments of the present invention, it will be obvious to those skilled in the art that various changes and modifications may be made therein without departing from the true spirit and scope of the present invention.

What is claimed is:

1. A chemical replenishing system for supplying fixer and developer chemicals to a processor, comprising:

(A) a developer portion including a plurality of developer containers, each containing chemical fluids for providing photographic developing action, each container having a predetermined geometric outline, each container having a pierceable seal at one end thereof;

a developer tank;

a first support element bearing a plurality of stationary knives disposed above said developer tank, said element having openings therein below said knives;

a container-coded developer template having openings therein, each opening corresponding to a respective one of said developer containers, each of said openings being arranged above a corresponding knife, each opening for providing loading indentification of an associated container and for providing means to guide said container onto its respective knife; and (B) a fixer portion including a plurality of fixer containers, each containing chemical fluids for providing photographic fixing action, each container having a predetermined geometric outline, each container having a pierceable seal at one end thereof;

a fixer tank;

a second support element bearing a plurality of stationary knives disposed above said fixer tank, said element having openings therein below said knives; and a container-coded fixer template having openings therein, each opening corresponding to a respective one of said fixed containers, each of said openings being arranged above a corresponding knife, each opening for providing loading identification for an associated container and for providing means to guide said container onto its respective knife; and means for supplying water to each of said tanks at a pressure greater than incoming line pressure, said water supplying means for mixing a solution of water and chemicals in each of said tanks;

whereby the loading of a container into a template opening and onto a knife will cause the knife to pierce the seal of the container and allow the fluid contained therein to pass through the corresponding support element opening into the corresponding tank.

2. The system of claim 1 including means for sensing when a predetermined amount of solution has been supplied to the tank and means for shutting off said water supply in response to said sensing means.

3. The system of claim 1 including means for sensing when the chemical fluids in said developer tank has reached a minimum level and means for providing an alarm signal in response thereto.

4. The system of claim 3 wherein said alarm signal is both aural and visual.

5. The system of claim 1 including means for sensing when the chemical fluids in said fixer tank has reached a minimum level and means for providing an alarm signal in response thereto.

6. The system of alarm 5 wherein said alarm signal is both aural and visual.

7. The system of claim 1 including means for sensing when either the solution in said developer tank or the solution in said fixer tank has reached a predetermined level and means responsive thereto for preventing further supply of water to either the developer or fixer tanks when said predetermined level has been reached.

8. The system of claim 7 wherein said means preventing further supply of water includes means for resetting said prevention means upon the addition of a predetermined quantity of developer or chemical fluids to corresponding developer or fixer tanks so as to thereby allow the introduction of water.

* * * * *